US008320795B2

(12) United States Patent
Miller

(10) Patent No.: US 8,320,795 B2
(45) Date of Patent: Nov. 27, 2012

(54) IMAGING CARTRIDGE HAVING A DISPLACEABLE BODY

(76) Inventor: Steven Miller, Pinellas Park, FL (US)

( * ) Notice: Subject to any disclaimer, the term of this patent is extended or adjusted under 35 U.S.C. 154(b) by 0 days.

(21) Appl. No.: 13/282,203

(22) Filed: Oct. 26, 2011

(65) Prior Publication Data

US 2012/0039628 A1 Feb. 16, 2012

Related U.S. Application Data

(63) Continuation of application No. 11/743,937, filed on May 3, 2007, now abandoned.

(60) Provisional application No. 60/746,882, filed on May 9, 2006.

(51) Int. Cl.
*G03G 21/16* (2006.01)

(52) U.S. Cl. ..... 399/111

(58) Field of Classification Search ..... 399/111, 399/119

See application file for complete search history.

(56) References Cited

U.S. PATENT DOCUMENTS 5,809,376 A * 9/1998 Chiesa et al. ..... 399/111
6,308,036 B1 * 10/2001 Taniyama et al. ..... 399/262
2004/0114959 A1 * 6/2004 Daniels ..... 399/109

* cited by examiner

*Primary Examiner* — David Gray
*Assistant Examiner* — Gregory H Curran
(74) *Attorney, Agent, or Firm* — Jesse Delcamp

(57) ABSTRACT

Provided is a printer cartridge having a resilient pliable body. The resilient pliable body of the printer cartridge conforms to obstructions located in different positions inside the printer cartridge receiving cavity of different models and brands of printers. When the resilient pliable front of the printer cartridge contacts an obstruction in the cartridge receiving cavity of a printer, it is displaced in that area so that it is not an obstruction any longer, allowing the printer cartridge to fit and operate in multiple brands and families of printers.

17 Claims, 10 Drawing Sheets

IMAGING CARTRIDGE HAVING A DISPLACEABLE BODY

CROSS REFERENCE TO RELATED APPLICATIONS

This application is a continuation of co-pending U.S. patent application Ser. No. 11/743,937 entitled: "Imaging Cartridge Having a Displaceable Body," filed May 3, 2007, which claims priority to U.S. Provisional Patent Application No. 60/746,882, entitled, "Pliable Wastebin—Multiple Contact Chip—Magnetic Wastebin-Hopper Coupling", filed May 9, 2006.

BACKGROUND OF THE INVENTION

The present invention relates to a printer cartridge adapted to fit within a printer cartridge-receiving cavity of a printer.

Laser printers use a coherent beam of light, hence the term "laser printer," to expose discrete portions of an image transfer drum thus attracting the printing toner. Toner is a mixture of pigment (most commonly black) and plastic particles. The toner becomes electro-statically attracted to exposed portions of the image transfer drum. The toner is transferred to paper, or other medium, as it passes over the rotating image transfer drum. Subsequently, the paper is heated so that the plastic is melted thereby permanently affixing the ink to the paper. Any excess toner on the image transfer drum that is not transferred to the paper is removed from the drum by a wiper blade and stored in the wastebin assembly of the printer cartridge.

The vast majority of commercially available laser printers include replaceable or removable printer cartridges that incorporate an image transfer drum, a toner tank, and a metering system. A drive mechanism is connected to the drum and metering system. Modern printer cartridges often include a variety of sensors that interact with the laser printer to indicate the status of the cartridge. Indications relating to toner level, print quality and general cartridge function are often included as well. A large number of types and sizes of printer cartridges are currently available. The sensing system typically includes an encoder wheel interconnected with a rotating agitating paddle within a cylindrical toner tank or hopper assembly. Movement of the agitating paddle feeds toner into the metering system. The encoder wheel reports the movement of the agitating paddle through the toner reservoir.

Each printer manufacturer designs its printers to accept printer cartridges manufactured by it and to reject the printer cartridges manufactured by others. More particularly, to increase sales of their own printer cartridges, printer manufacturers have added electronic identification features and structural features to the printers and to the printer cartridges that do not enhance the functional performance of the printer in any way but which serve to prevent use of a competitor's printer cartridge in the printer. Printer manufacturers also prefer to sell new toner cartridges to replace empty toner cartridges. Therefore, they do not support the re-cycling industry.

Thus there is a need for a single printer cartridge that can be used with printers made by differing manufacturers and with differing printer models made by a common manufacturer. There is also a need for a printer chip that enables a single toner cartridge to be used with printers made by differing manufacturers and with differing printer models made by a common manufacturer. In addition to new cartridges, such a printer chip could be used in conjunction with spent cartridges that are re-filled with toner by the re-cycling industry when empty.

Additionally, many printer cartridges employ a method of replacing the hopper assembly multiple times without replacement of the wastebin assembly or photoconductor unit, but they all employ mechanical means of latching and biasing to one another which an end user has to uncouple then re-couple.

Therefore, what is needed is a printer cartridge that employs a method of coupling a hopper assembly with a wastebin assembly magnetically so the hopper assembly is easily removed and reinstalled in the wastebin assembly without having to uncouple and re-couple a latching means.

SUMMARY OF THE INVENTION

The long-standing but heretofore unfulfilled need for a printer cartridge capable of being used with printers made by differing manufacturers and with differing printer models made by a common manufacturer, and which also includes other improvements that overcome the limitations of prior art printer cartridges is now met by a new, useful, and non-obvious invention.

The invention includes a printer cartridge adapted to fit in the printer cartridge receiving cavity of a printer. The wastebin assembly of the printer cartridge has a resilient pliable front that conforms to obstructions located in different positions inside the printer cartridge receiving cavity of different models and brands of printers. When the resilient pliable front of the printer cartridge contacts an obstruction in the cartridge receiving cavity of a printer, it collapses in that area so that it is not an obstruction any longer.

The resiliency of the resilient pliable wastebin assembly allows the wastebin assembly to return to its original shape once it is no longer contacting an obstruction. This allows the wastebin assembly to maximize the volume of toner it can hold. When the wastebin assembly is moved from a printer having obstructions in one location to a printer having obstructions in differing locations, the wastebin assembly is only collapsed in the area presently contacting an obstruction.

In another embodiment, the printer cartridge contains a printer chip with a plurality of sets of contacts, each set of contacts capable of interoperation with a different type of printer, cartridge, or photoconductor unit. The chip is installed on the cartridge with the chosen set of contacts oriented to mate with the electrical contacts in the printer cartridge receiving cavity of the printer. The result is a chip that can be installed on a printer cartridge or photoconductor unit in a plurality of orientations in order to allow the printer cartridge or photoconductor unit to interoperate with a plurality of types of printers, or allow a plurality of types of printer cartridges or photoconductor units to interoperate with a printer.

Yet another embodiment is a hopper assembly and wastebin assembly interconnected and biased by magnets without mechanical latching. In this way, an end user can remove the hopper assembly from the wastebin assembly (or photoconductor unit) and replace the expelled hopper assembly without having to latch or unlatch any mechanisms.

The magnetic wastebin-hopper coupling can be employed in several ways. Magnets can be placed on both the hopper assembly and wastebin assembly with the same poles oriented towards each other so the magnets repel each other and push the wastebin assembly and hopper assembly together, or the magnets can be placed with opposite poles facing each other so the magnets attract each other and pull the wastebin assembly and hopper assembly together. Additionally, a magnet can be placed on one of the assemblies and a magnetically attractive material can be placed on the other assembly so that the magnet is attracted to the magnetically attractive material and the two assemblies are pulled together.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
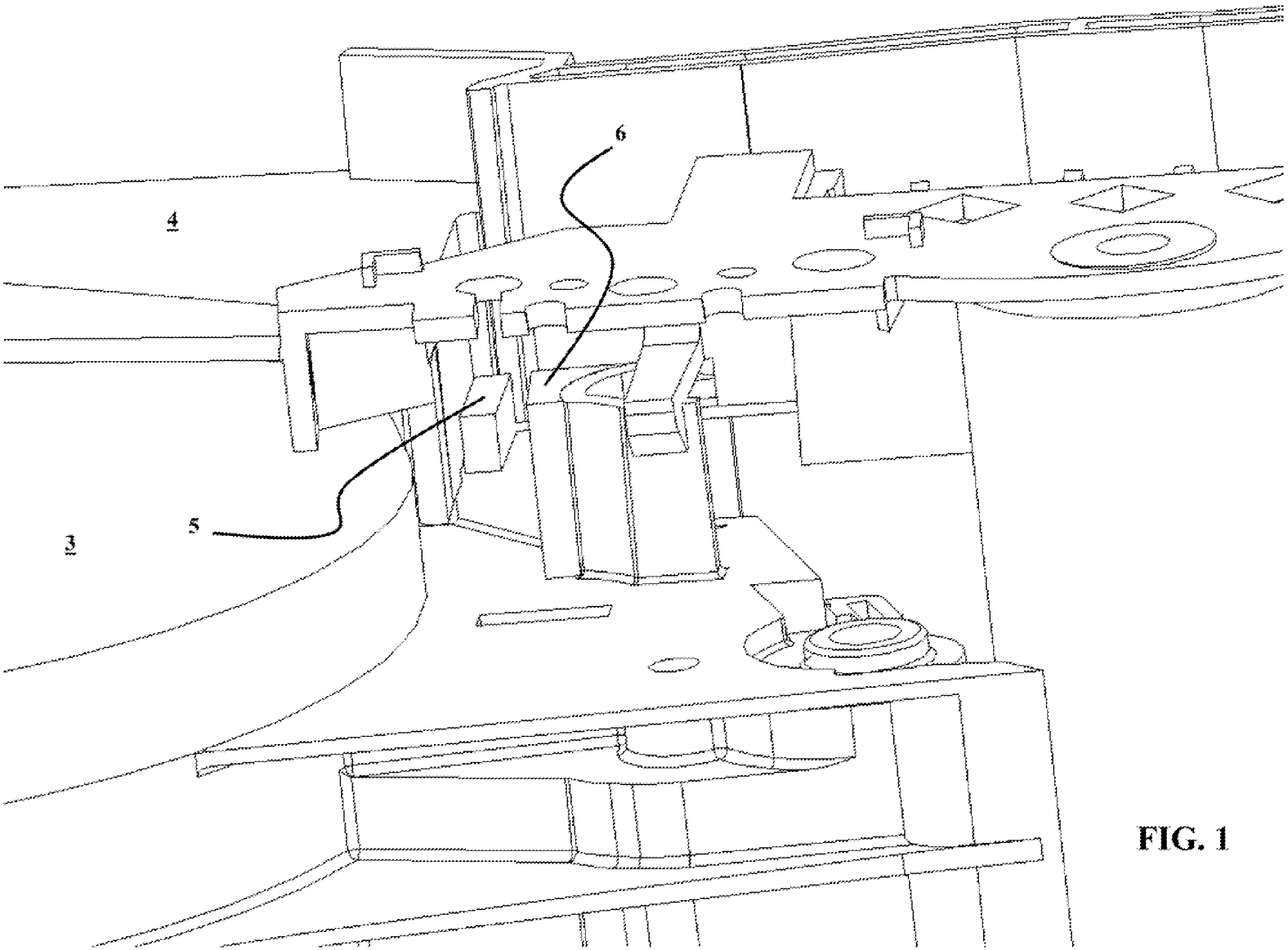
FIG. 1 shows magnet 5, attached to wastebin assembly 4, repelling magnet 6, attached to hopper assembly 3.
Figure 2:
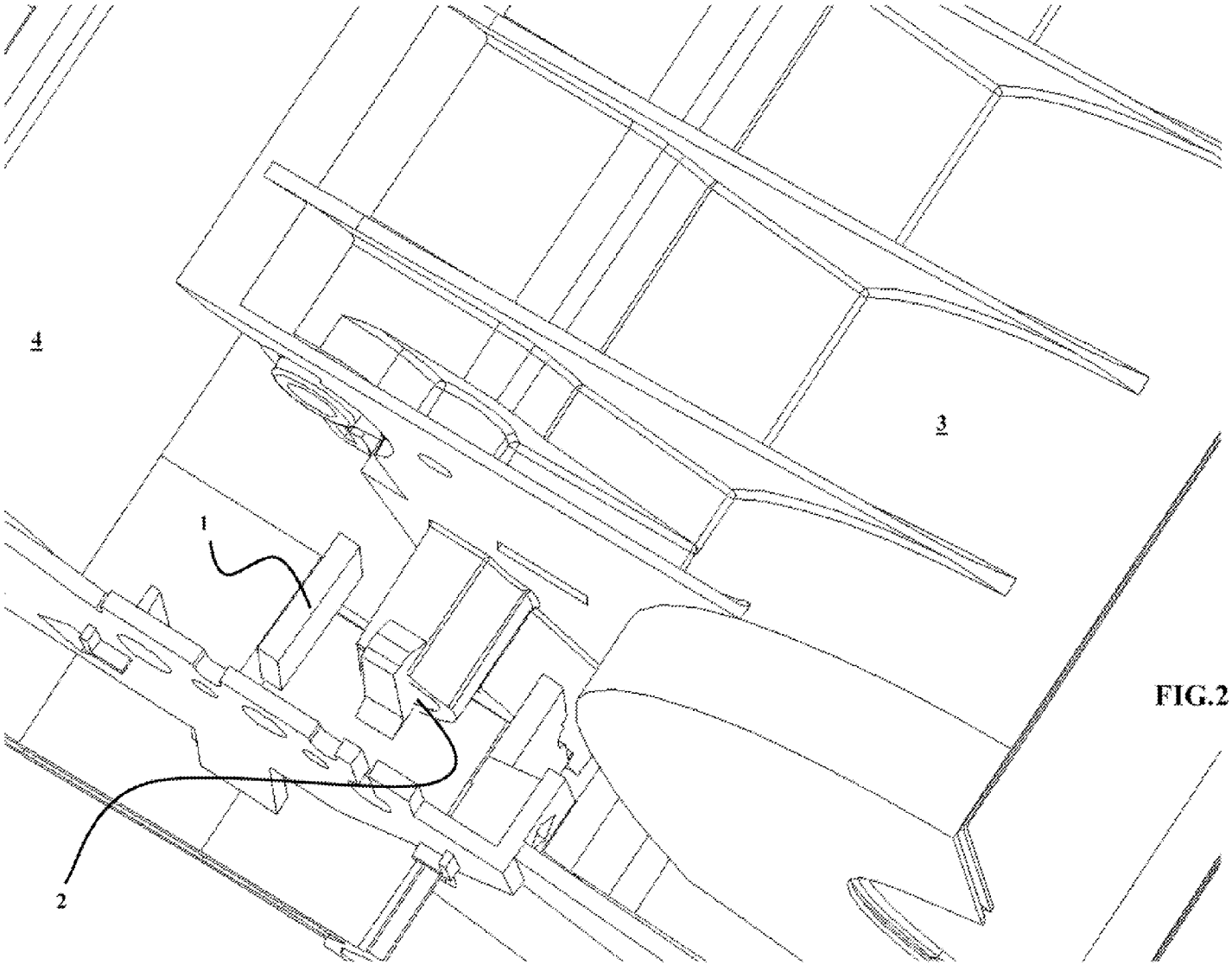
FIG. 2 shows magnetically attractive material 1, attached to wastebin assembly 4, attracting magnet 2, attached to hopper assembly 3.
Figure 3:
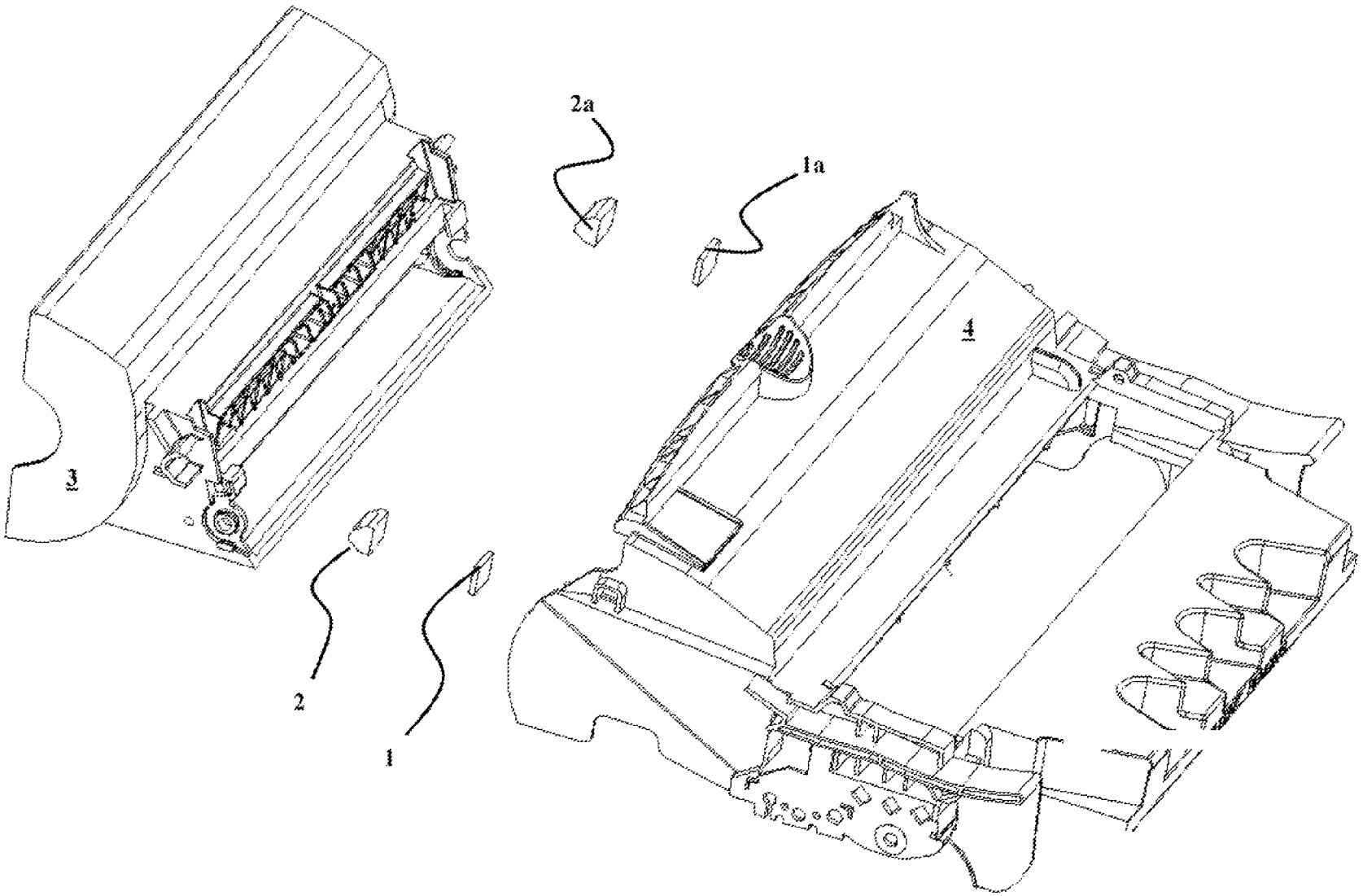
FIG. 3 is an exploded view of FIG. 2

FIGS. 1 through 3 illustrate one embodiment of the invention wherein a hopper assembly is coupled to a wastebin assembly using magnets. The magnetic coupling system can be employed in several different ways. FIG. 1 shows magnet 5 attached to wastebin assembly 4 and magnet 6 attached to hopper assembly 3. Magnets 5 and 6 are oriented with the same poles facing each other so that they repel each other. The result is hopper assembly 3 is biased forward, forming a nip (contact) between the developer roller and the photoconductive drum.

FIG. 2 shows magnet 2 attached to hopper assembly 3 and magnetically attractive material 1 attached to wastebin assembly 4. Magnet 2 is attracted to material 1. The result is hopper assembly 3 is biased forward, forming a nip (contact) between the developer roller and the photoconductive drum. Additionally, the magnet can be attached to the wastebin assembly and the magnetically attractive material can be attached to the hopper assembly to achieve the same result. Magnetically attractive material 1 is any material that attracts magnet 2, including a magnetically attractive metal or a magnet oriented with its opposite pole facing magnet 2.

It is also anticipated that the hopper and wastebin assemblies can be magnetically coupled together by mounting a magnet on the inside of the printer cartridge receiving cavity of the printer that is positioned to either attract or repel a magnet mounted to either the hopper or wastebin assembly, biasing the hopper and wastebin assemblies together.

Figure 4:
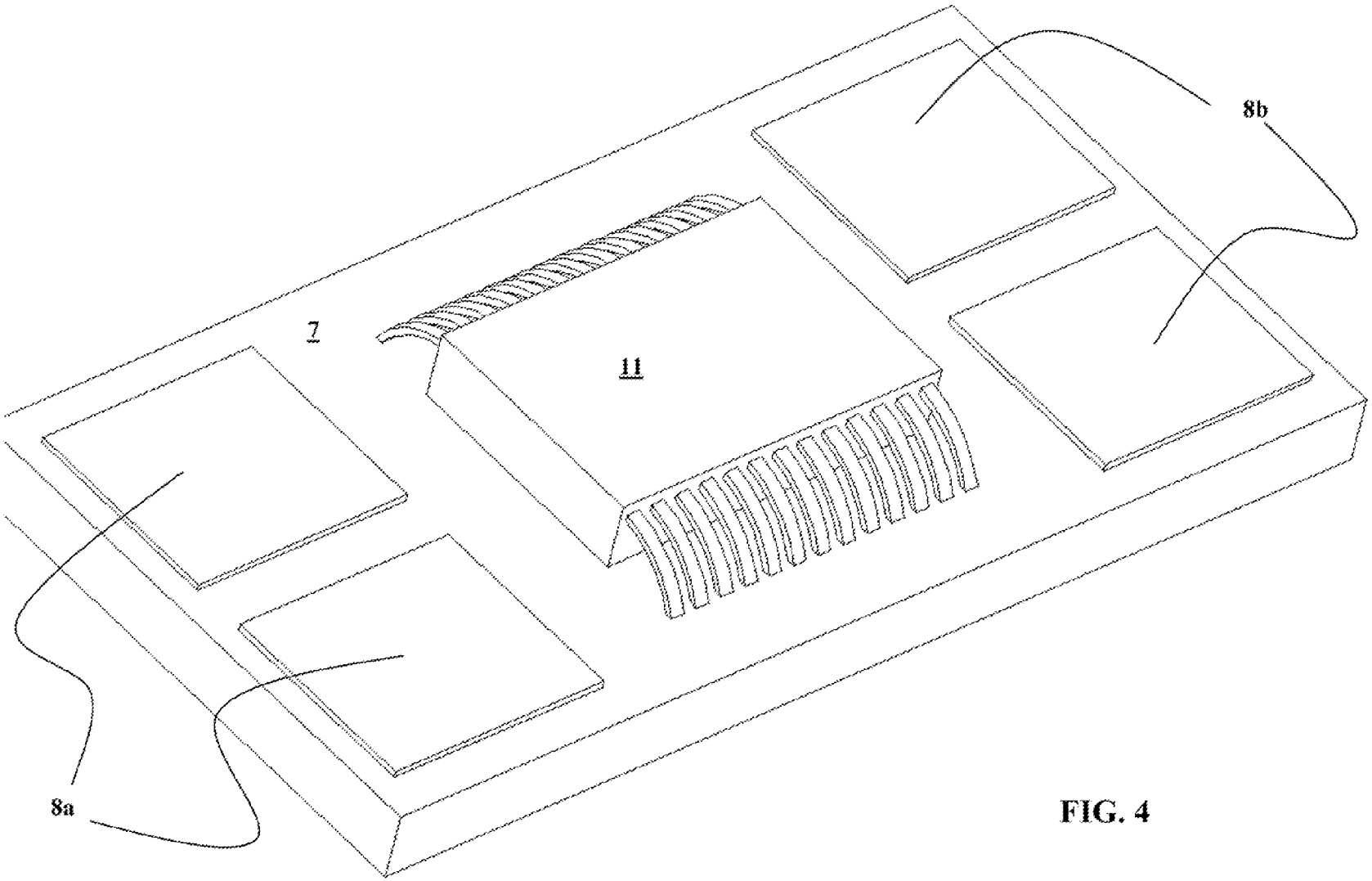
FIG. 4 shows a detailed view of the multiple contact printer chip
Figure 5:
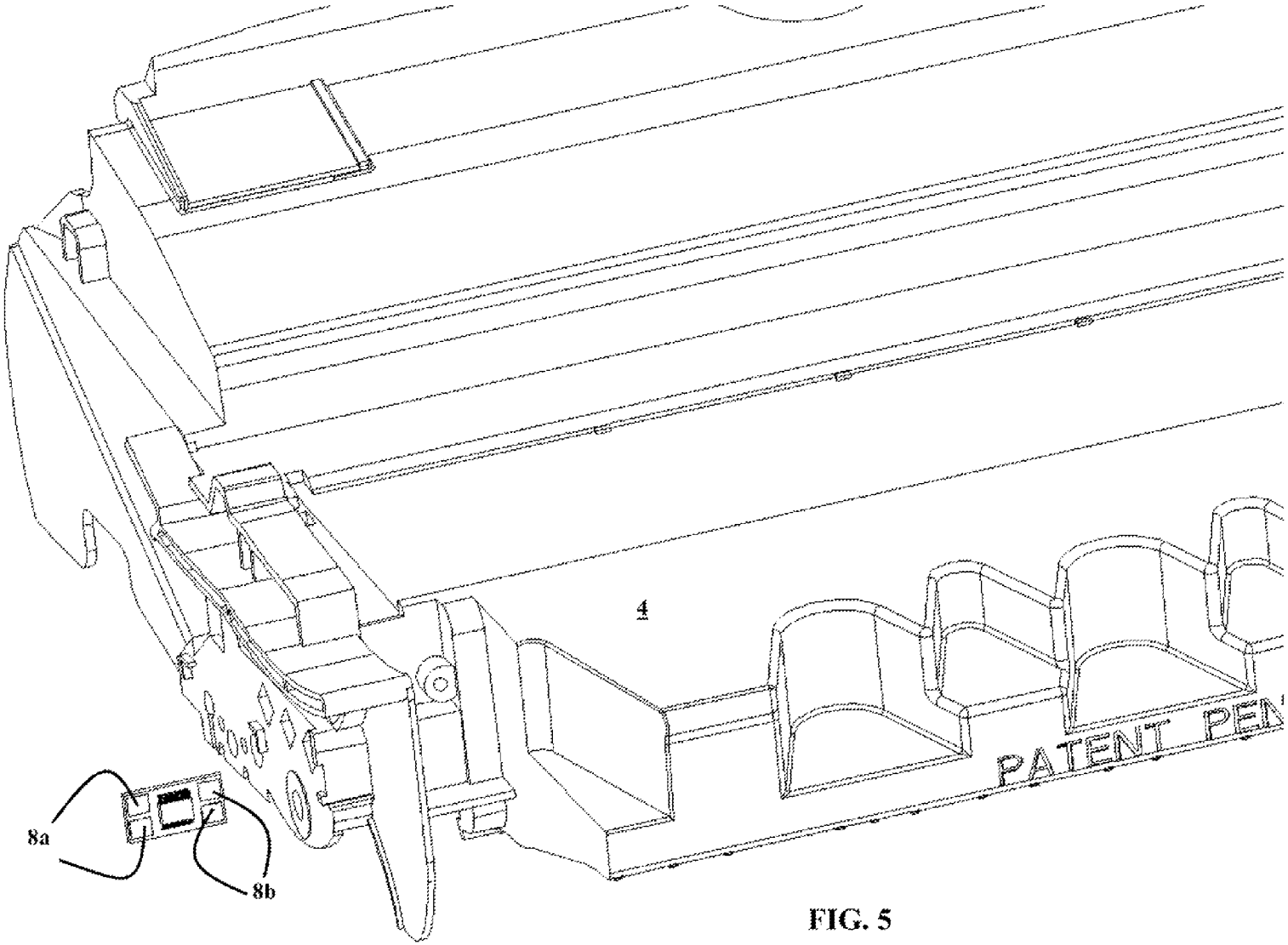
FIG. 5 is an exploded view of a multiple contact printer chip and a printer cartridge.

The magnetic coupling system of the invention is not limited to printer cartridges; it can be used with any imaging cartridge that operates in any imaging machine including cartridges for facsimile machines, photo copiers, and scanners, in addition to ink jet cartridges, solid ink cartridges, and electro photographic cartridges. Additionally, the magnetic coupling system is not limited to coupling wastebin assemblies to hopper assemblies, other imaging assemblies such as photoconductor units can be coupled to hopper assemblies or wastebin assemblies in the same fashion FIGS. 4 through 6*a* illustrate another novel embodiment of the invention wherein the printer cartridge contains a printer chip having a plurality of sets of contacts, each set of contacts capable of allowing interoperation of different types of cartridges or photoconductor units with different types of printers. FIG. 4 shows the multiple contact printer chip 7 which contains bi-directional data processor 11 and contact sets 8*a* and 8*b*. Bi-directional data processor 11 contains information required for interoperation of a cartridge or photoconductor unit with different types of printers or a printer with different types of cartridges or photoconductor units. Each set of contacts is connected to bi-directional data processor 11 and is adapted to allow a type of cartridge or photoconductor unit to interoperate with a printer.

Figure 6:
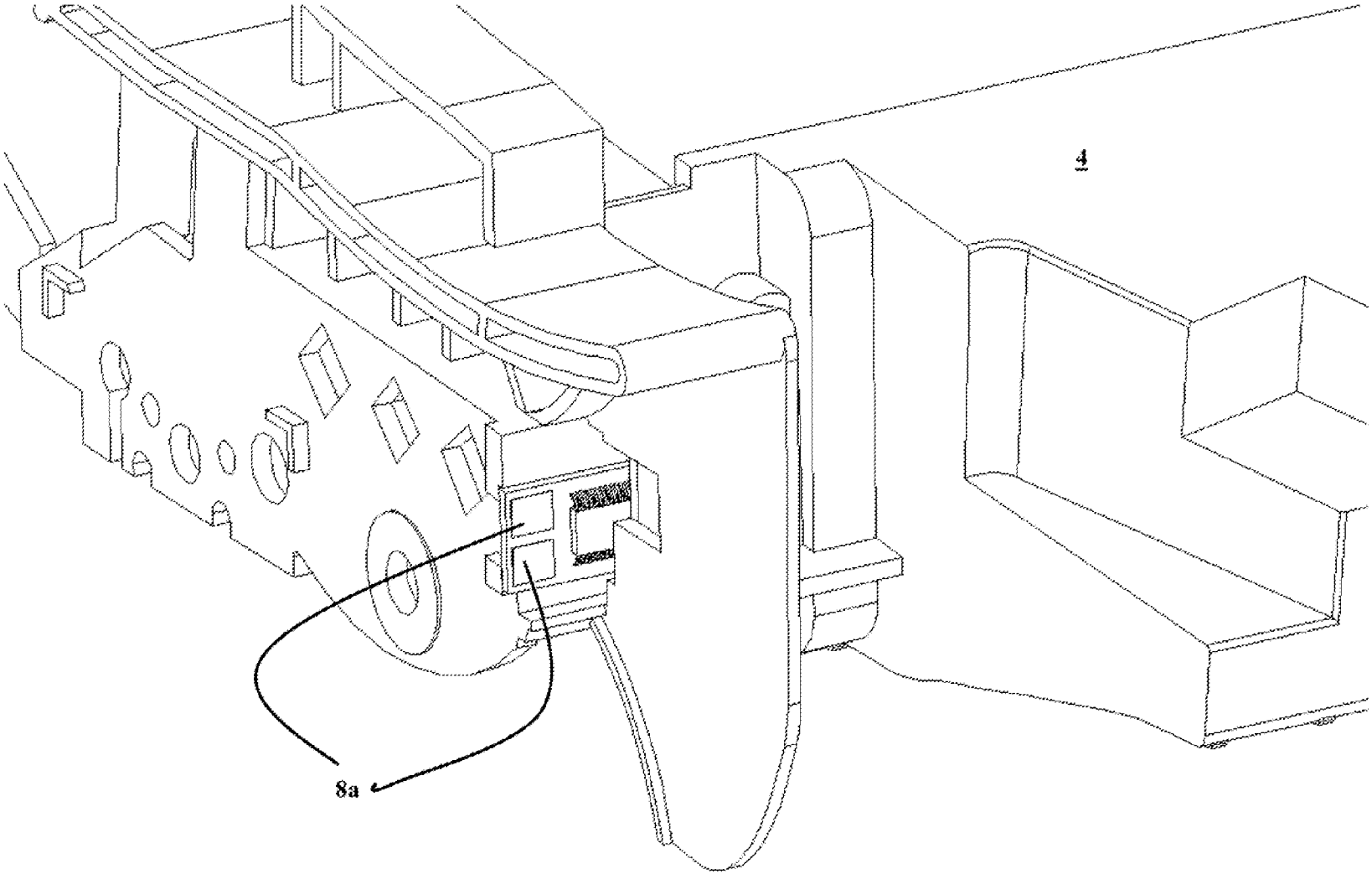
FIG. 6 shows a multiple contact printer chip installed in a printer chip mounting area of a printer cartridge with contacts 8*a* exposed.
Figure 6A:
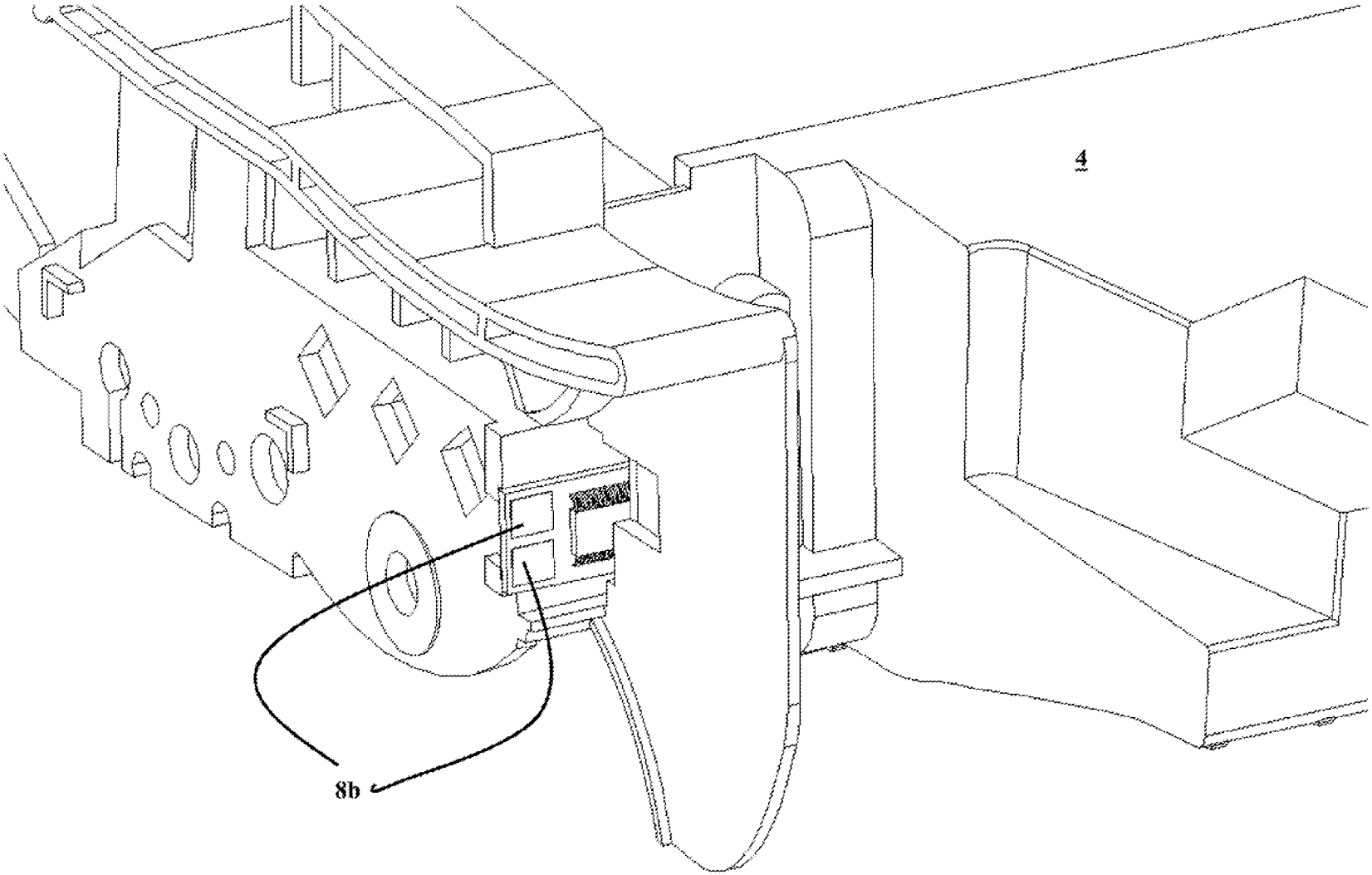
FIG. 6*a* shows a multiple contact printer chip installed in a printer chip mounting area of a printer cartridge with contacts 8*b* exposed.

Printer chip 7 can be installed on the printer cartridge or photoconductor unit with either contact 8*a* or 8*b* oriented to make contact with the corresponding contact points in the printer cartridge receiving cavity of a printer. FIG. 6 shows printer chip 7 installed on a printer cartridge with contacts 8*a* exposed and FIG. 6*a* shows printer chip 7 installed on a printer cartridge with contacts 8*b* exposed. The result is a printer chip that can be installed on a printer cartridge or photoconductor unit in a plurality of orientations in order to allow the printer cartridge or photoconductor unit to interoperate with a plurality of printers, or allow a plurality of printer cartridges or photoconductor units to interoperate with a printer. The printer chip can also be oriented on a printer cartridge so that one set of printer chip contacts is aligned to make contact with the corresponding contact points in the printer cartridge receiving cavity of a printer having contact points in a first location and the other set of contacts is aligned to make contact with the corresponding contact points in the printer cartridge receiving cavity of a different printer having contact points in a second location.

The invention is not limited to 2 sets of contacts. More sets of contacts can be used if needed.

The chip with multiple contacts has utility in several applications. In one application, a set of contacts can interoperate with different models of printers. A user can choose a model printer and determine which set of contacts on the multiple contact printer chip interoperate with the chosen printer. The chip is then installed on a printer cartridge or photoconductor unit with the chosen model contacts in the correct position to mate with the electrical contacts in the printer cartridge receiving cavity of the printer.

In a second application, a set of contacts can interoperate with different brands of printers. A user can choose a brand of printer and determine which set of contacts on the multiple contact printer chip interoperate with the chosen printer. The chip is then installed on a printer cartridge or photoconductor unit with the chosen brand contacts in the correct position to mate with the electrical contacts in the printer cartridge receiving cavity of the printer.

In another application, each set of contacts is associated with the data for a different type of printer cartridge or photoconductor unit. A user can choose a type of printer cartridge or photoconductor unit and determine which set of contacts on the multiple contact printer chip are associated with the corresponding type of printer cartridge or photoconductor unit. The chip is then installed on the printer cartridge or photoconductor unit with the chosen contacts in the correct position to mate with the electrical contacts in the printer cartridge receiving cavity of the printer.

Examples of different types of printer cartridges or photoconductor units are:

a) MICR toner or normal toner
b) high yield or low yield
c) different color toners (magenta, cyan, yellow, black)
d) different regions (U.S. or European, etc.)
e) different density settings (dark or light)
f) any different combination of printer cartridge settings
g) different voltage printers (120V or 220V)
h) prebate or non-prebate
i) any combination of dedicated chip functions (not limited to 2)

The printer chip having a plurality of contact sets is not limited to use on printer cartridges. It can be used with any imaging machine (i.e. facsimile machines, scanners, photo copiers, etc.) or imaging component (i.e. ink jet cartridges, solid ink cartridges, photoconductor units, etc.) that has multiple sets of functions and/or parameters.

Figure 7:
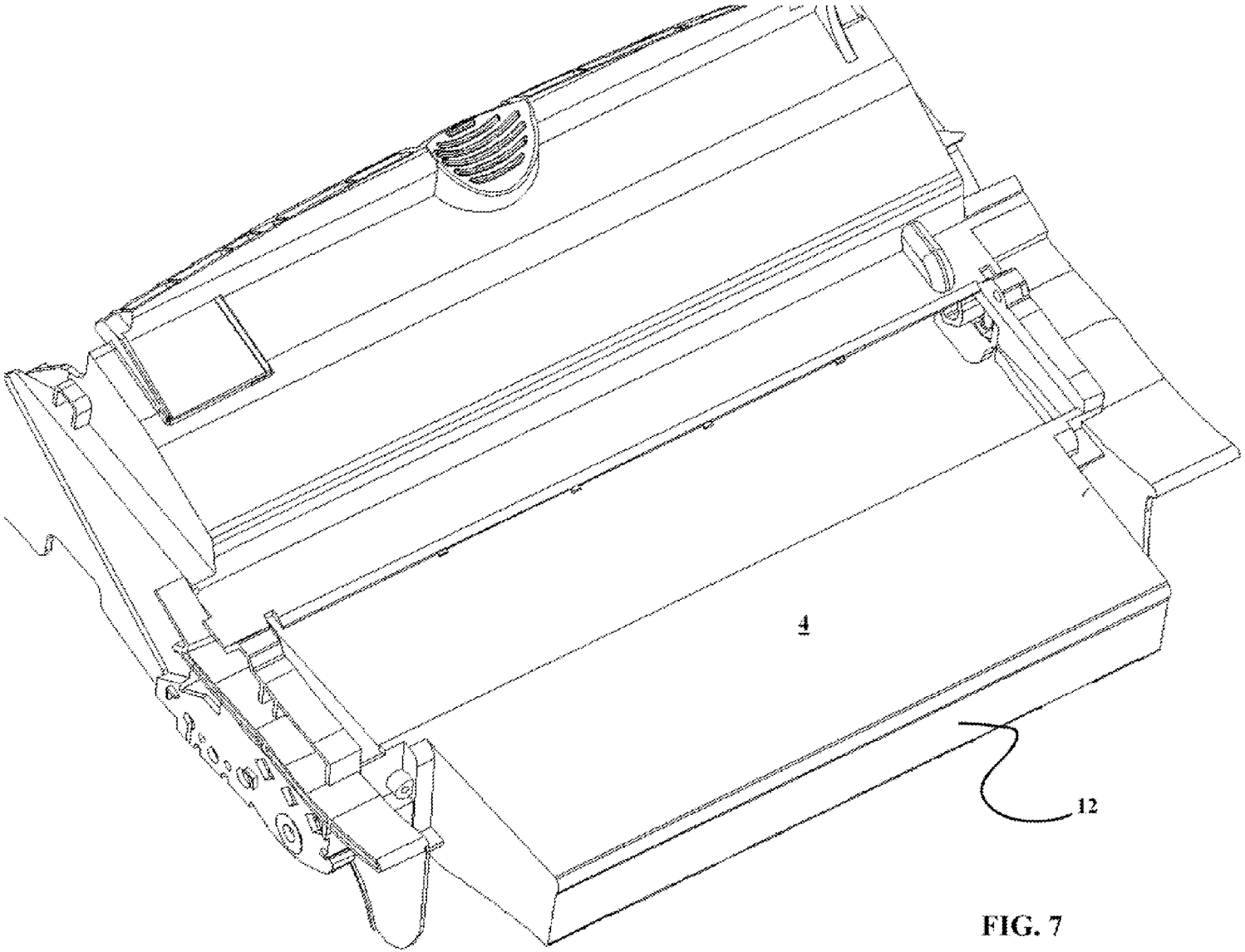
FIG. 7 shows a printer cartridge with a wastebin assembly having no recess.
Figure 8:
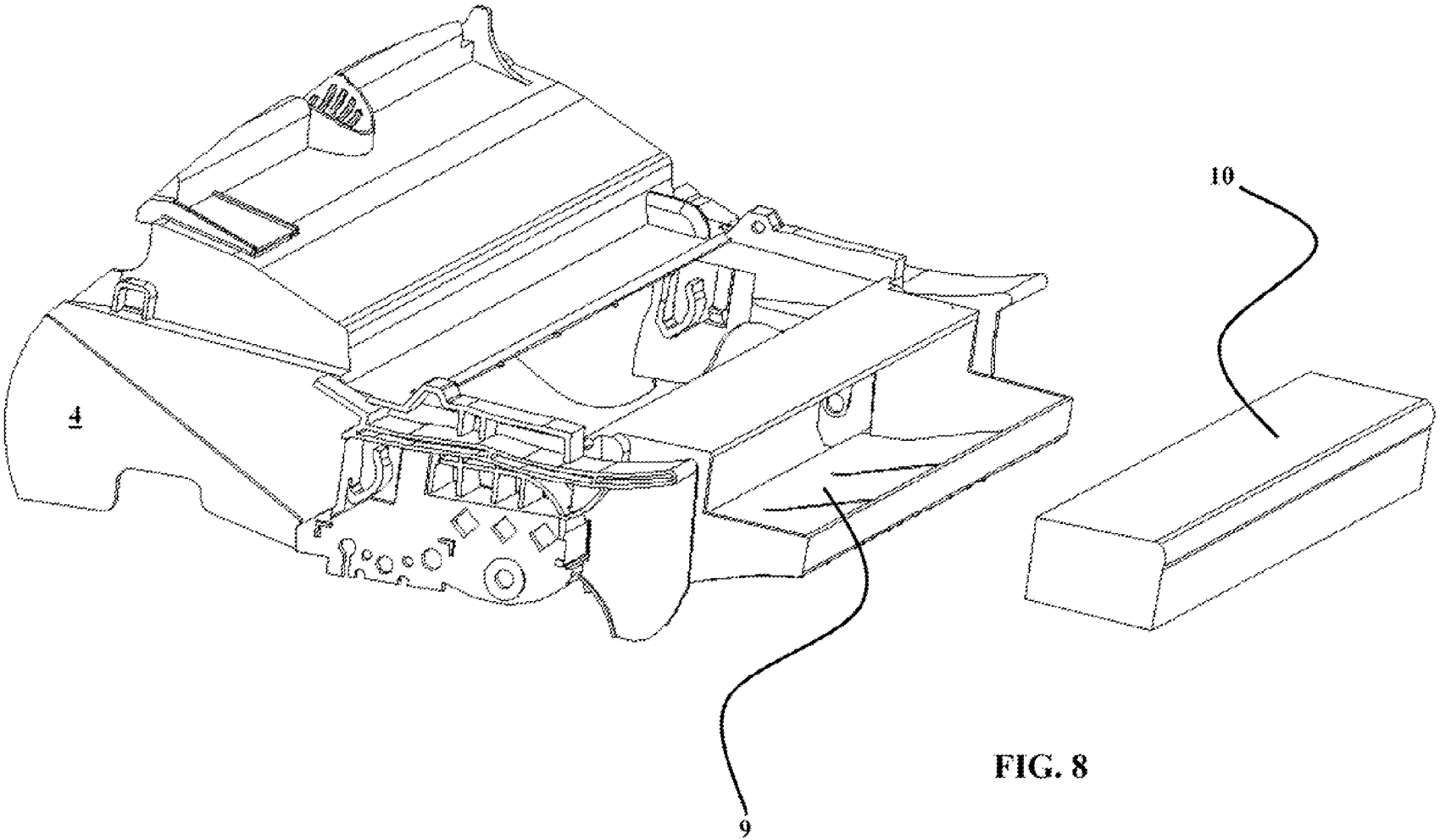
FIG. 8 shows an exploded view of a wastebin assembly with an open area for a resilient pliable structure 10 to cover.
Figure 9:
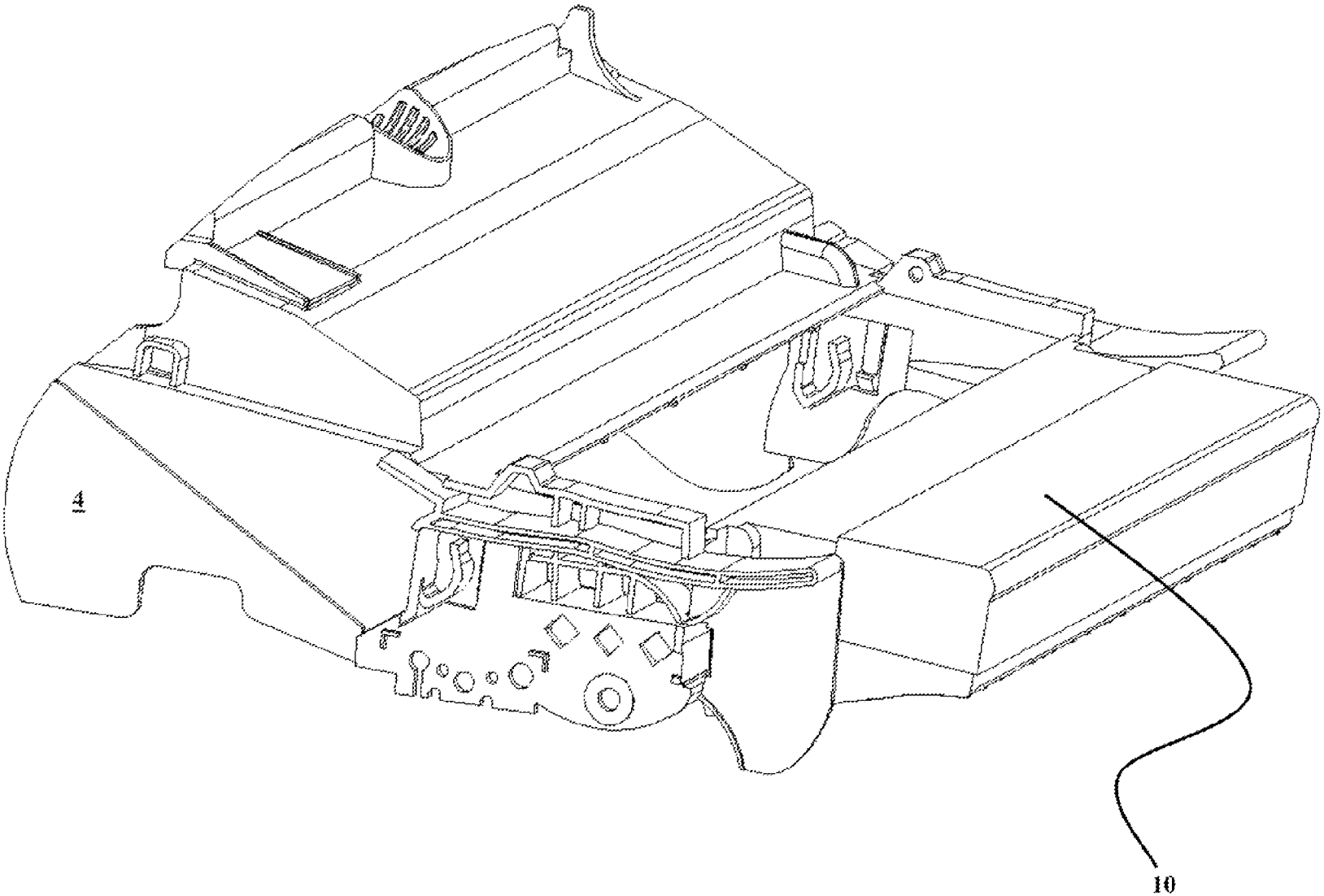
FIG. 9 shows a wastebin assembly with a resilient pliable structure 10 installed.

Another embodiment of the novel invention is illustrated in FIGS. 7 through 9 wherein wastebin assembly 4 is equipped with a resilient pliable structure 10 allowing the wastebin assembly to conform to the printer cartridge receiving cavity of a plurality of printer models. Rigid front end 12 is removed from wastebin assembly 4 creating recess 9. Resilient pliable structure 10 is attached to the front of wastebin assembly 4, and is sealed along its edges to prevent the escape of toner from the wastebin assembly.

FIG. 9 shows a printer cartridge with the resilient pliable structure 10 attached.

The resilient pliable structure 10 begins with an initial shape. When the resilient pliable structure 10 of wastebin assembly 4 contacts an obstruction in the printer cartridge receiving cavity of a printer it is deformed from its initial shape as it is displaced in relation to the rest of the wastebin and conforms to the obstruction so that it is not an obstruction any longer. As a result, the wastebin assembly is able to fit into its operating position in the printer cartridge receiving cavity of multiple different brands and models of printers having obstructions in varying locations.

The resilient pliable wastebin assembly also improves the printer cartridge in that it allows the printer cartridge to hold the maximum volume of waste toner. The wastebin assemblies of the current art have recesses to avoid obstructions in the printer cartridge receiving cavities of printers. These recesses reduce the volume of waste toner that can be contained in the wastebin assembly of the printer cartridge. The resilient pliable adapting front of the invention does not have any shapes formed in it that reduce the volume of toner the wastebin assembly can store. Although, the resilient pliable wastebin of the invention can return to its original shape once it is no longer contacting an obstruction, it is also anticipated that it can remain collapsed after it is no longer contacting an obstruction.

It is also anticipated that the resilient pliable structure can be applied to any type of imaging cartridge that operates in any imaging machine including ink jet cartridges, and electro photographic cartridges, in addition to cartridges for facsimile machines, scanners, copiers and the like. This technology can be integrally formed into a new universal imaging cartridge, or can be applied as a modification to an existing imaging cartridge. Additionally, this technology can be applied to imaging cartridges that comprise a wastebin assembly and a hopper assembly coupled together, or imaging cartridges having a wastebin assembly and a hopper assembly incorporated together into one body. Also, this resilient pliable technology can be applied to any area of an imaging cartridge body that could be an obstruction in an imaging device.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. An imaging cartridge, comprising:
a body adapted to fit in an imaging machine having an imaging cartridge receiving cavity with an obstruction;
said body comprising a portion comprised of a pliable material;
said portion comprising an initial shape;
said portion adapted to be deformed from said initial shape by said obstruction when said imaging cartridge is installed and seated into its operating position in said imaging cartridge receiving cavity.

2. The imaging cartridge of claim 1 wherein said portion of said body is resilient and returns to its initial shape once it is no longer contacting said obstruction.

3. The imaging cartridge of claim 1, further comprising:
said imaging machine being a first imaging machine;
said imaging cartridge receiving cavity being a first imaging cartridge receiving cavity;
said obstruction being a first obstruction in a first location;
said body adapted to fit in a second imaging machine having a second imaging cartridge receiving cavity with a second obstruction in a second location;
said portion adapted to be deformed from said initial shape by said second obstruction when said imaging cartridge is installed and seated into its operating position in said second imaging cartridge receiving cavity.

4. The imaging cartridge of claim 3 wherein said portion of said body is resilient and returns to its initial shape once it is no longer contacting said first or said second obstruction.

5. The imaging cartridge of claim 1, wherein:
said body comprises a wastebin; and
said wastebin comprises said portion comprised of said pliable material.

6. The imaging cartridge of claim 5 wherein said portion of said body is resilient and returns to its initial shape once it is no longer contacting said obstruction.

7. A method for using an imaging cartridge, said method comprising the steps of:
providing said imaging cartridge comprising a body adapted to fit in a first imaging machine having an imaging cartridge receiving cavity with an obstruction;
said body comprising a portion comprised of a pliable material;
said portion comprising an initial shape;
inserting said imaging cartridge into said imaging cartridge receiving cavity;

said portion contacting said obstruction;

said portion being deformed from said initial shape by said obstruction when said imaging cartridge is installed and seated into its operating position in said imaging cartridge receiving cavity.

8. The method of claim 7, wherein:

said portion of said body is resilient and returns to its initial shape once it is no longer contacting said obstruction.

9. The method of claim 7, further comprising:

said imaging machine being a first imaging machine;

said imaging cartridge receiving cavity being a first imaging cartridge receiving cavity;

said obstruction being a first obstruction in a first location;

said body adapted to fit in a second imaging machine having a second imaging cartridge receiving cavity with a second obstruction in a second location.

10. The method of claim 7, wherein:

said body comprises a wastebin; and said wastebin comprises said portion comprised of said pliable material.

11. The method of claim 10 wherein said portion of said body is resilient and returns to its initial shape once it is no longer contacting said obstruction.

12. An imaging cartridge, comprising:

a body adapted to fit in an imaging machine having an imaging cartridge receiving cavity with an obstruction;

said body comprising a leading end and a trailing end;

said leading end entering said imaging cartridge receiving cavity before said trailing end when said imaging cartridge is inserted into its operating position in said imaging cartridge receiving cavity;

said leading end comprising a portion comprised of a pliable material;

said portion comprising an initial shape;

said portion adapted to be displaced in relation to said trailing end by said obstruction when said imaging cartridge is installed and seated into its operating position in said imaging cartridge receiving cavity.

13. The imaging cartridge of claim 12, wherein:

said portion of said body is resilient and returns to its initial shape once it is no longer contacting said obstruction.

14. The imaging cartridge of claim 12, further comprising:

said imaging machine being a first imaging machine;

said imaging cartridge receiving cavity being a first imaging cartridge receiving cavity;

said obstruction being a first obstruction in a first location;

said body adapted to fit in a second imaging machine having a second imaging cartridge receiving cavity with a second obstruction in a second location;

said portion adapted to be displaced in relation to said trailing end by said second obstruction when said imaging cartridge is installed and seated into its operating position in said second imaging cartridge receiving cavity.

15. The imaging cartridge of claim 14, wherein:

said portion of said body is resilient and returns to its initial shape once it is no longer contacting said first or said second obstruction.

16. The imaging cartridge of claim 12, wherein:

said body comprises a wastebin; and said wastebin comprises said portion comprised of said pliable material.

17. The imaging cartridge of claim 16 wherein said portion of said body is resilient and returns to its initial shape once it is no longer contacting said obstruction.

* * * * *